US006474503B2

(12) United States Patent
Davis

(10) Patent No.: US 6,474,503 B2
(45) Date of Patent: Nov. 5, 2002

(54) CUP LID DISPENSER

(76) Inventor: Larry E. Davis, 297 Lee Pritchett Rd., Ellijay, GA (US) 30540

( * ) Notice: Subject to any disclaimer, the term of this patent is extended or adjusted under 35 U.S.C. 154(b) by 110 days.

(21) Appl. No.: 09/772,544

(22) Filed: Jan. 30, 2001

(65) Prior Publication Data

US 2001/0038017 A1 Nov. 8, 2001

Related U.S. Application Data

(60) Provisional application No. 60/181,879, filed on Feb. 11, 2000.

(51) Int. Cl.[7] ..... B65H 3/28
(52) U.S. Cl. ..... 221/223; 221/298
(58) Field of Search ..... 221/223, 221, 221/226, 232, 188, 297, 298, 1

(56) References Cited

U.S. PATENT DOCUMENTS 5,975,839 A * 11/1999 Ashby ..... 221/223

* cited by examiner

*Primary Examiner*—Kenneth W. Noland

(57) ABSTRACT

This apparatus and method for dispensing lids, such as plastic cup lids for drinking cups, one-by-one from a nesting stack of lids disposed slidable inside a vertically oriented elongated housing, such stack being initially supported from underneath the bottommost lid by a pair of lateral pivoting support plate members. Operating the dispenser by depressing a yoke-lever member urging a symmetrical outboard pair of resilient flat spring jaws laterally inward, engaging from opposing sides, flanged outer rim on such cup lid that immediately overlays the bottommost lid, causing the overlaying cup lid to be flexed, lifted, and ovally distorted. Such oval distortion wedges the overlaying lid between the resilient flat spring jaws and against the inner wall of the elongated housing vertically supporting the overlaying lid and all lids lying thereon. Further action of the yoke-lever will move the pair of support plates to an unsupporting position allowing bottommost lid to fall free, dispensed. Releasing the yoke-lever member to resting position sequentially restores the pair of support plates to a supporting configuration, and allows the resilient flat spring jaws to relax resting-releasing allowing the overlaying lid, and remaining stack of lids lying thereon to settle down supported underneath by the support plates, thus completing one lid dispense-recharge cycle.

4 Claims, 6 Drawing Sheets

CUP LID DISPENSER

This application claims the benefits of Provisional Patent Application Ser. No. 60/181,879 filed date, Feb. 11, 2000.

This invention relates to an apparatus and method for dispensing lids one-by-one, such as ordinary plastic lids for drinking cups.

BACKGROUND OF THE INVENTION

Disclosure document filed Date, May 12, 1998.

Beverages, such as soft drinks, coffee, hot soups, and the like are often dispensed in plastic and paper cups which need cup lids for safety and cleanliness. Cup lids are usually dispensed from open containers or free standing stacks. These lids are often dropped on the floor or scattered out on tables whereas your lid might be handled by several people before you get it. Stacks of these lids can become stuck together making it necessary to use both hands for separating a single lid from the stack. Unnecessary time is often spent manually separating and dispensing lids which hinders food service efficiency. Drink vending machines have no clean and practical means for dispensing cup lids.

Dispensing method such as by Antonio Dodaro, U.S. Pat. No. 5,322,188, having many complicated parts, would be somewhat difficult and expensive to manufacture. Garske, U.S. Pat. No. 5,944,220, loading cup lids would be time consuming and placing cup lids on center rod member could be an unsanitary chore. Cunningham, U.S. Pat. No. 392,824, would provide no sanitary means for cups and lids, and would require much handling of lids.

There is a need for an economical; easy to use, space saving, cup lid dispenser which will handle lids in a more sanitary fashion. This invention addresses these needs and meets them successfully.

SUMMARY OF THIS INVENTION

A primary object of this invention is providing an improved means for cleanly dispense cup lids, such as coffee cup lids and the like, one by one from a nesting stack of such lids.

OBJECTS AND ADVANTAGES

1 This cup lid dispensing method is the only known art that will ovally distort and therefore wedge the first lid overlaying the bottommost lid in a nesting stack. Such wedging of the overlaying lid against the inner walls of a surrounding housing will vertically support it and all remaining lids lying thereon. Such vertical supporting leave the bottommost lid alone to be dispensed when underlying support is removed. Restoring underlying support meanwhile ovally unwedging the overlaying lid will allow it and all lids lying thereon to become vertically unsupported whereas they will drop down supported by the before stated resting underlying support thus completing one dispense and recharge cycle of cup lids.

2 Housing cup lids in an inclosed elongated housing whereas they are protected from dirty handling, spillage, and airborne contaminants.

3 Providing an easy one hand operation for dispensing cup lids, leaving remaining hand for carrying food and the like.

4 Providing easy manipulating for handicap persons.

5 This dispensing apparatus has no hard to manufacture cams and sliding rod devises as does prior art, Dorado U.S. Pat. No. 5,322,188.

6 This dispensing apparatus can be mounted inside or outside a vending machine.

7 This dispensing apparatus may be mounting on a vertical wall surface, or horizontal counter top surface.

8 This dispensing apparatus will perform if positioned substantially out of plumb or level.

9 This dispensing apparatus has a see-thru loading door for viewing quantity, size, and such, of remaining cup lids in magazine.

10 This dispensing apparatus may be mounted in its own free standing cabinet.

11 This dispensing apparatus may be cleaned like any kitchen appliance.

12 This dispensing apparatus can have lid capacity for a full, as supplied, sleeve of cup lids.

The general object of this invention is achieved by placing a nesting slidable stack of cup lids inverted from their normal usage, inside a substantially vertical oriented elongated housing allowing the stack of lids to drop down initially supported from underneath the bottommost lid by a pair of lateral pivoting support plates. Operating this dispenser by ovally wedging-supporting the outer flanges from opposing sides the first lid overlaying the bottommost lid, between a pair of flat resilient spring jaws which will flex, elevate, and ovally wedge such lid between the jaws, and inside the housing, vertically supporting it and all lids lying over it. The bottommost lid now resting alone still supported underneath by the pivoting support plates. Pivot the support plates laterally to an unsupporting position will allow bottommost lid to drop free dispensed and reachable by user. Restoring the lateral pivoting supporting plates resting and supporting, meanwhile releasing the pair of resilient flat spring jaws, allowing the first overlaying cup lid along with all lids lying over it to drop down supported underneath by the pair of lateral pivoting support plates thus completing one dispense and recharge cycle of cup lids.

SUMMERY OF DRAWINGS

DESCRIPTIVE PREFERRED EMBODIMENTS DISPENSING

Figure 1:
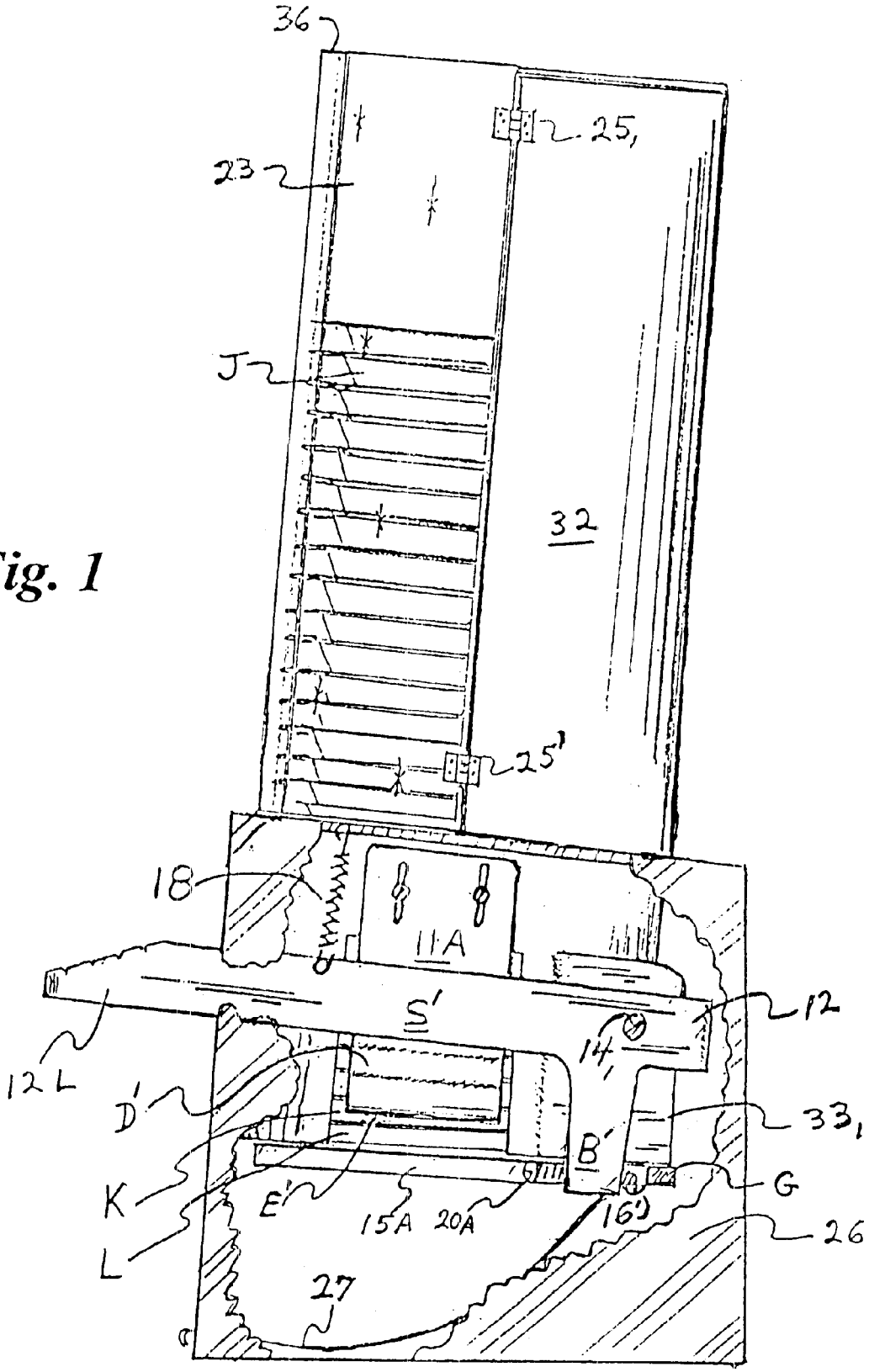
FIG. 1 is a side view of this invention with support cabinet cutaway revealing apparatus resting, with vertically supported stack of cup lids therein.

FIG. 1 is a side elevation of this dispensing apparatus whereas a nesting stack of cup lids J placed therein inverted from normal usage into upper magazine portions of elongated housing 32 through access door 23 allow cup lid stack J to drop down into lower portion of housing 32 initially resting supported underneath by lateral pivoting support plates 15A and 15B.

Figure 9:
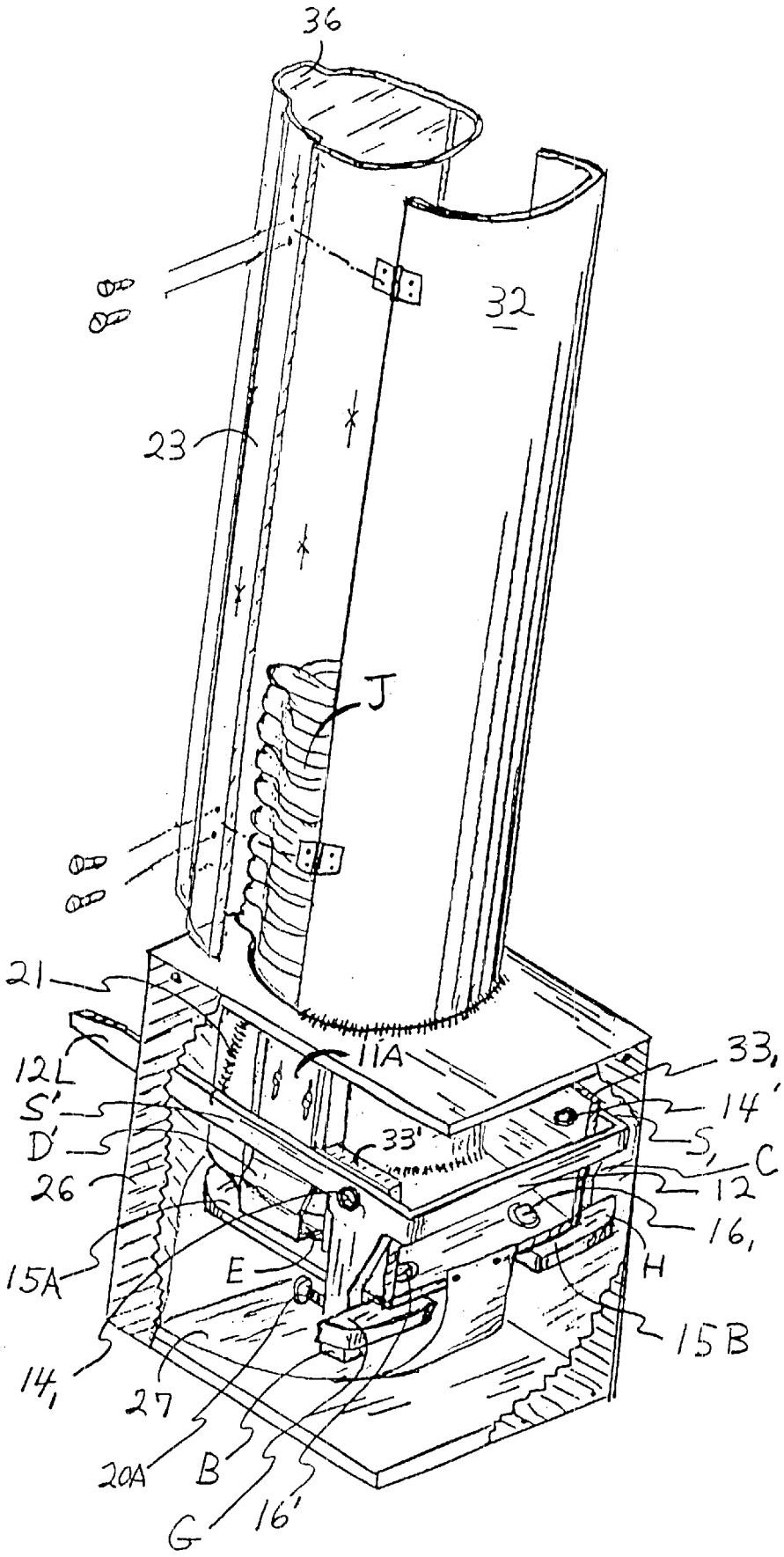
FIG. 9 is a perceptive view of this cup lid dispensing apparatus cutaway revealing embodiments with detached loading door.

FIG. 1 further describes this elevation with partly cutaway cabinet 26 revealing lever portion 12L of yoke member 12 extending forward reachable by user and, furthermore dispensing apparatus assembly in FIGS. 1 and 9 tilted slightly rearward from vertical, whereas cup lid stack J is resting stable rearward inside the magazine portions 32, therefore such stability leaves primary use for the access door 23 for lid sanitation only.

Figure 2:
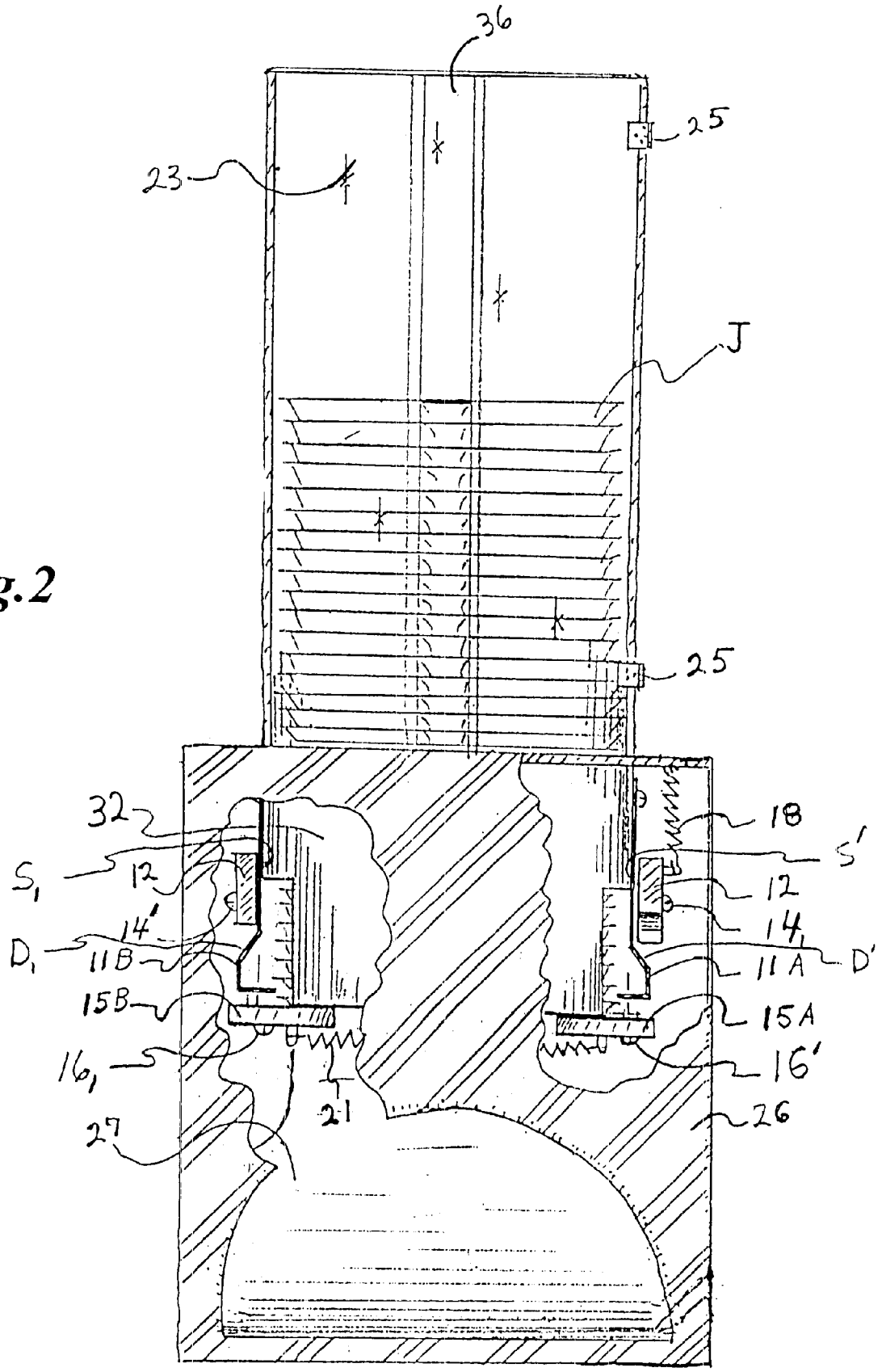
FIG. 2 is a front view of this invention with support cabinet cutaway revealing apparatus resting, with vertically supported stack of cup lids therein.

FIG. 2 is a front elevation of this dispenser in resting position with partial cutaway support cabinet 26 revealing an inverted stack of cup lids resting supported underneath by pivoting support plates 15A and 15B.

Figure 3:
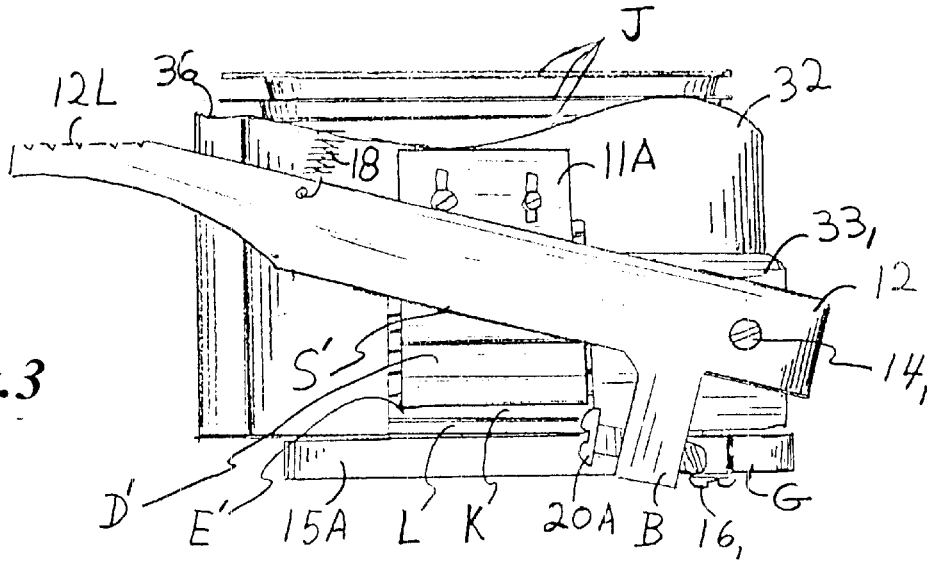
FIG. 3 is an out of cabinet fragmented view of this dispensing apparatus with upper magazine portion cutaway, and showing control lever extended forward resting.

FIG. 3 is an out of cabinet elevation view of this dispensing apparatus with upper magazine portions of elongated housing 32 cutaway, showing some dispensing embodiments comprising yoke 12 resilient flat spring jaw 11A and lateral pivoting support member 15A resting.

Figure 4:
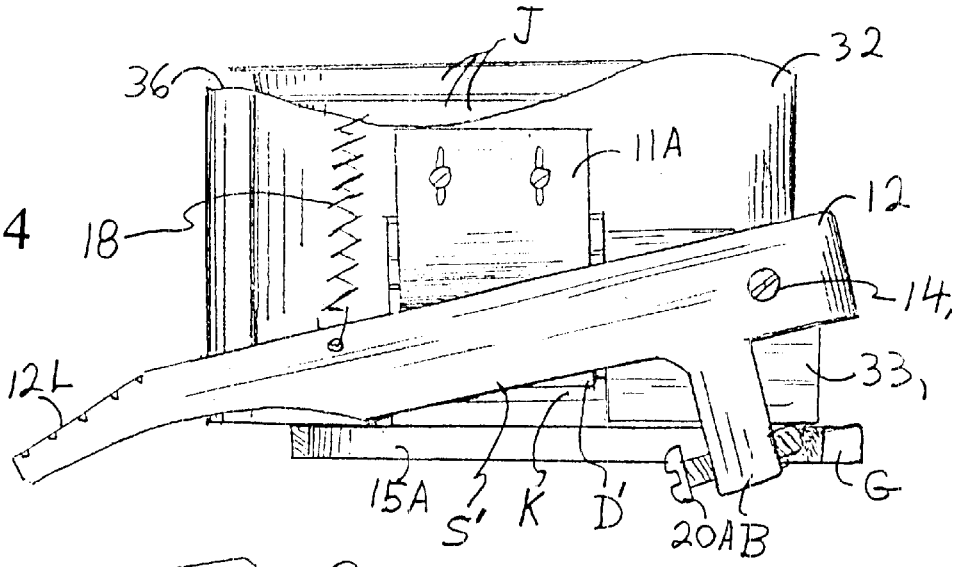
FIG. 4 is an out of cabinet fragmented view of this dispensing apparatus revealing yoke-lever in downward dispensing position.

FIG. 4 is an out of cabinet elevation view of this dispensing apparatus with upper magazine portions of elongated housing 32 cutaway, revealing some embodiments comprising yoke 12 resilient flat spring jaw 11A and lateral pivoting support plate 15A in dispensing configuration.

Figure 5:
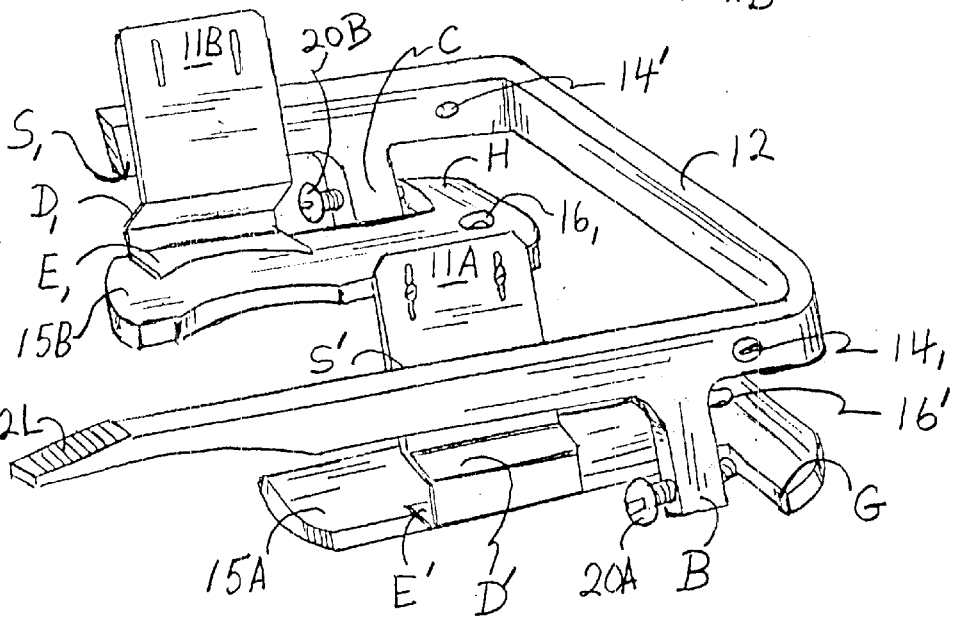
FIG. 5 is a perspective view of moving embodiments of this dispenser correctly oriented resting and unmounted.
Figure 8:
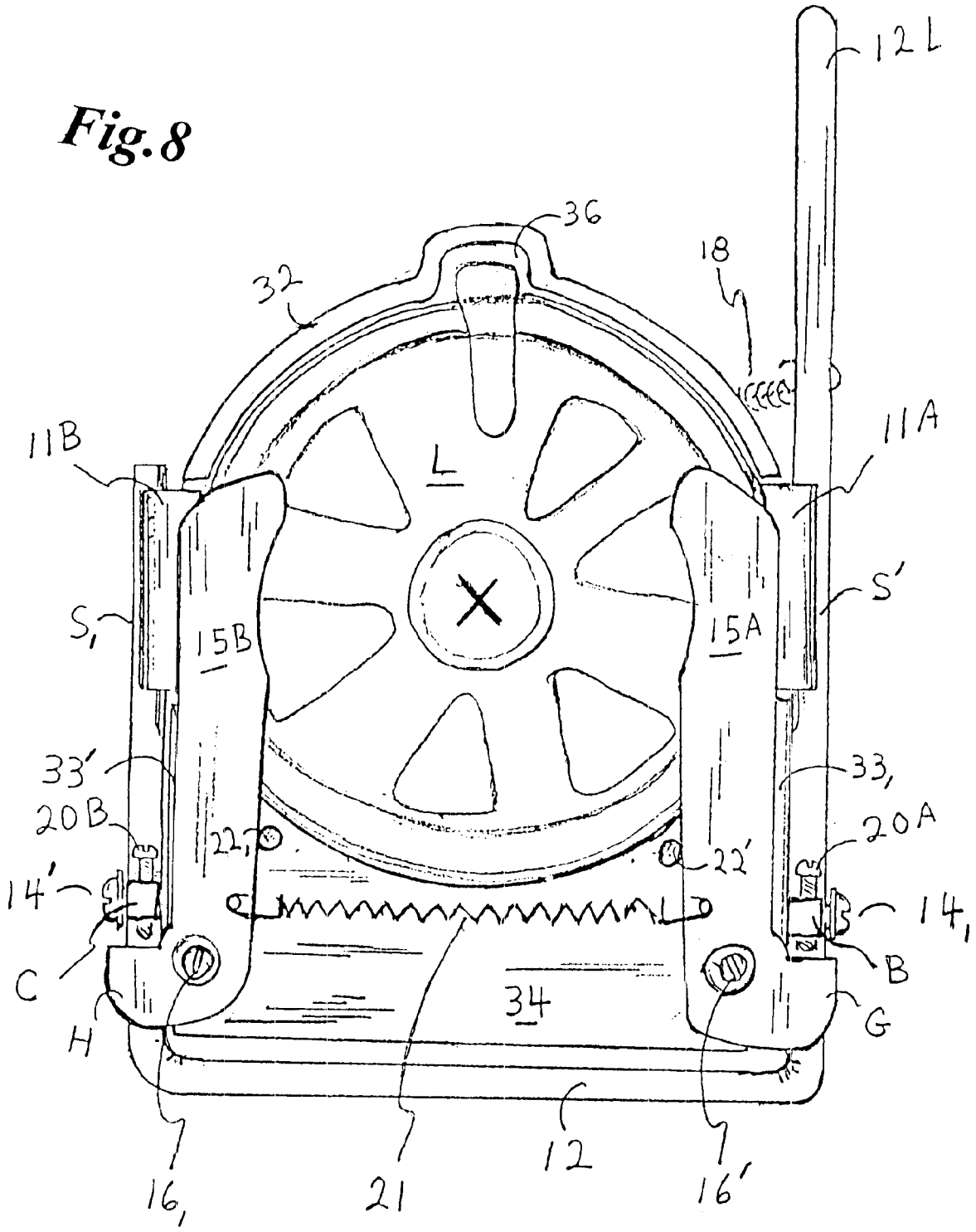
FIG. 8 is a bottom view of this dispensing apparatus whereas underlying support member is resting supporting

FIG. 4 further shows yoke 12 is pivotally attached at rear of elongated housing 32 onto attaching plates 33, 33' at horizontal points 14, 14' points 14' and 33' are out of view in this drawing but understood in FIGS. 5, 8, and 9 drawings.

FIG. 5 is a perceptive open view showing configurations and features of yoke member 12 resilient flat spring jaws 11A and 11B and support plates 15A and 15B.

FIG. 5 further reveals rear horizontal pivot points 14, 14' for vertical pivoting yoke 12 whereas said yoke 12 is U shaped with arm portions S, and S' pointing forward astride resilient flat spring jaws 11A and 11B.

Figure 6:
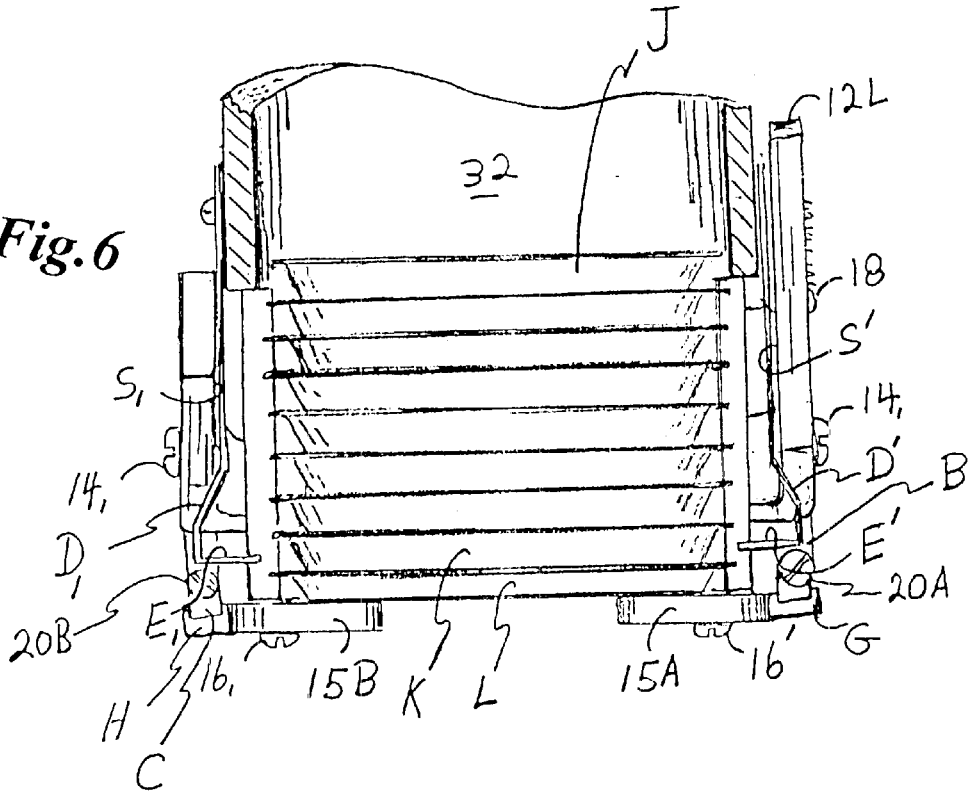
FIG. 6 is a front elevation of this dispensing apparatus whereas elongated housing is cutaway revealing a nested stack of cup lids therein inverted from their normal usage support vertically underneath.

FIG. 6 is a frontal cutaway of this dispensing apparatus resting whereas a stack of cup lids J placed inverted from their normal usage therein elongated housing 32 vertically supported underneath by lateral pivoting support plates 15A and 15B with yoke portions 12 pivoted upward resting.

Figure 7:
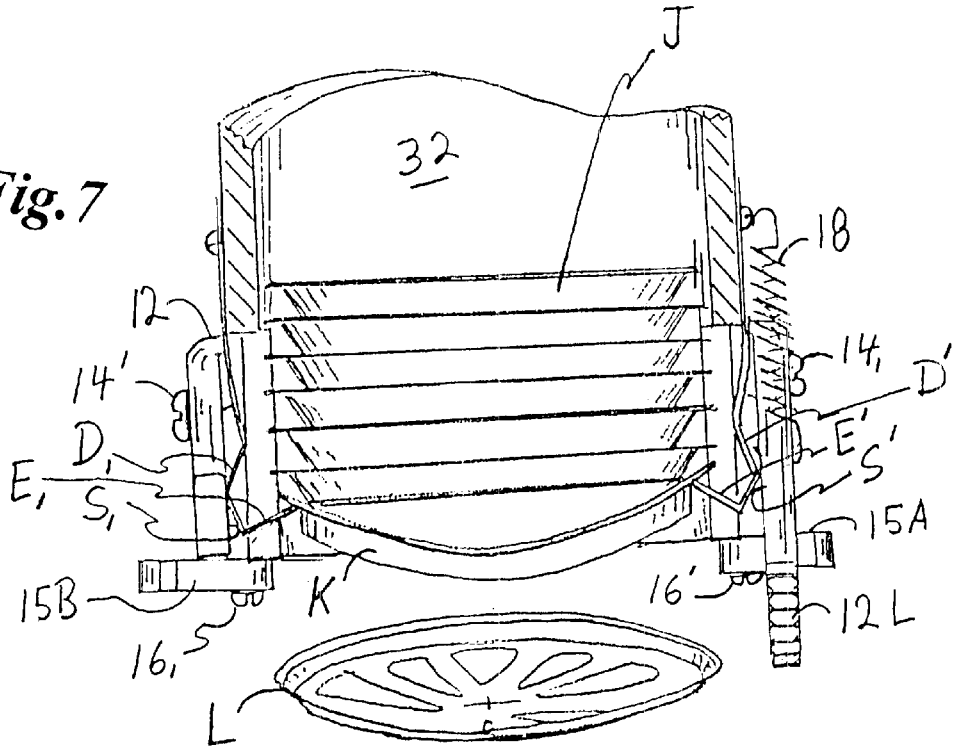
FIG. 7 is a front elevation of this dispensing apparatus whereas elongated housing is cutaway revealing first lid overlaying bottommost lid is wedged vertically supported and bottommost lid dispensed.

FIG. 7 is a front cutaway view of elongated housing 32 whereupon S, S' arms portions of yoke 12 having slid down vertically along ramp portions D, D' of resilient flat spring jaw members 11A and 11B urging jaw portions E, E' of resilient flat spring members 11A and 11B to curve along an inward-upward arcing lateral path engaging cup lid K from opposing outer flanges whereas the engaging has squeezed, flexed, elevated and wedged lid K between jaw portions E, E' meanwhile ovally wedging, lid K against front and rear inner wall portions of elongated housing 32 thus vertically supporting cup lid K and all lids lying thereon.

FIG. 7. further shows pivoting support plates 15A and 15B have moved laterally to an unsupporting position allowing cup lid L to drop free dispensed into catch trough 27. (catch trough 27 being portion of support cabinet 26 shown in FIGS. 1 and 2), In clarifying forgoing dispensing action of support plates whereupon portions B and C of yoke 12 member, pushing against tang portions G and H of support plates 15A and 15B, whereas pivoting support plates 15A and 15B are moved to an unsupporting configuration. (Portions (B) (C) and (G) (H) understood in drawings FIGS. 5 and 8.)

FIG. 8 is an out of cabinet bottom view revealing bottom lid L inside elongated housing 32 with lid L supported underneath by pivoting support plates 15A and 15B. Support plates 15A and 15B being held resting-supporting against stops 22, 22' by spring 21 and, elongated housing 32 having elongated vertical inner trough 36 defining pull off tabs on cup lids.

FIG. 8 further shows yoke 12 astride elongated housing 32 with lever portion 12L of yoke 12 extended forward with feet portions B and C comprising calibrating screws 20A and 20B extended downward in front of tangs G and H said tangs G and H being portions of pivoting support plates 15A and 15B; support plates 15A and 15B attached onto bracket 34 at pivot points 16, 16'.

FIG. 8 terminating such sequencing action by releasing lever 12L allows spring 18 to pull yoke 12 to resting position. Such yoke releasing sequence allows spring 21 to pull pivoting support plate members 15A and 15B to resting supporting position against stop tabs 22, 22'. Meanwhile resilient flat spring jaw members 11A and 11B are relaxed to unsupporting position therefore K lid is released unsupported allowing it and all cup lids lying thereon to drop down supported underneath by resting support plates 15A and 15B thus completing one dispense and recharge cycle of cup lids.

OPERATION OF THIS DISPENSER

Place a stack of lids J inside housing 32 through loading door 23 allowing lids J to drop down initially supported vertically underneath by underlying support members 15A and 15B. The bottommost cup lid in lid stack J is cup lid L and the first overlaying cup lid from bottom is lid K. The support members 15A and 15B are pivotally attached for lateral pivoting onto bracket 34 at points 16, and 16'. The members 15A and 15B are urged resting against stops 22, and 22' in supporting position underneath lid L by tensioner 21. Operate this dispenser by moving downward, lever portion 12L of yoke member 12. Yoke member 12 being pivotally attached for vertical pivoting onto bracket 33, and 33' at points 14, and 14' Such downward movement of yoke 12 will cause portions S, and S' of the yoke 12 to slide vertically downward across ramp portions D, and D' of resilient flat jaw members 11A and 11B. Such vertical sliding action along the skewed outward angle ramps D, and D' will urge members 11A and 11B to an inward-upward arcing direction. Such arcing action will cause jaw portions E, and E' of members 11A and 11B to contact-urging from opposing sides, outer flanges of cup lid K. Such urging will squeeze and ovally wedge cup lid K between jaws E, and E' and between the inner walls of housing 32. Such wedging will vertically support lid K and all lid stack J lying thereon. Continued downward action of yoke member 12 will move feet portions B, and B' of the yoke 12 rearward. Calibrating screws 20A and 20B being threaded into feet B, and B' will contact tang portions G and H. As rearward action of feet B, and B' urge against G and H being portions of support members 15A and 15B; Such action will pivot support members 15A and 15B to an unsupporting position. Such unsupporting position will allow bottommost cup lid L to drop free out of housing 32. Releasing lever portion 12L will allow tensioner 18 to return yoke 12 resting. Such releasing of yoke 12 in a sequential action of releasing will first allow underlying support members 15A and 15B to be pulled resting against stops 22,22' by tensioner 21. Secondly 11A and 11B will curve in a downward-outward unwedging and unsupporting path whereas cup lid K will become vertically unsupported allowing it and all lid stack J lying thereon to drop down vertically supported underneath the bottommost lid as in the beginning. This completes one dispense and recharge cycle of cup lids.

Numerals 25, 25' represent mounting hinge points for optional loading door. Numeral 36 represents an elongated trough defining cup lid pull off tabs. Numeral 26 represents a support cabinet.

CONCLUSIONS AND RAMIFICATIONS

As the foregoing drawings and wordings demonstrate this cup lid dispensing apparatus will dispense cup lids one-by-one from a nested stack of lids placed inside a substantially vertical oriented elongated housing whereas the stack is initially supported underneath the bottommost lid by underlying lateral pivoting support plates, operating the dispenser by depressing a yoke-lever member urging a symmetrical outboard pair of resilient flat spring jaws laterally inward engaging from opposing sides flanged outer rim of such cup lid that immediately overlays the bottommost lid, causing the overlaying lid to be flexed, lifted, and ovally distorted, such oval distortion will wedge the overlaying lid between the resilient flat spring jaw members and against the inner walls of the elongated housing vertically supporting the overlaying lid and all lids lying thereon. Further action of the yoke lever member, moves the pair of support plates to an unsupporting position allowing bottommost lid to fall free dispensed. Releasing the yoke-lever member to resting position sequentially restores the pair of support plates to a supporting configuration, and allows the resilient flat spring jaws to relax resting-releasing, allowing the overlaying lid, and remaining stack of lids lying thereon to settled down supported underneath by support plates, thus completing one lid dispense-recharge cycle.

The forgoing sequencing descriptive action demonstrates that;

1A—a stack of cup lids are placed inside a vertical oriented housing whereas gravity will pull lids down into dispensing position vertically supported by lower underlying support means.

2A—the first lid overlaying the bottommost lid is squeezed from opposing outer flange walls into an oval shape whereas it is wedged against inner walls of housing overpowering gravity thus supported that lid and all lids lying thereon vertically.

3A—the bottommost lid is now resting alone on top of underlying support, and by removing the underlying support gravity will evacuate the bottommost lid from dispenser.

4A—the forgoing action of the upper and lower support-unsupport members was achieved whereas the yoke-lever member being manually acted upon. Furthermore when the yoke-lever is manually released resting, such reverse action of the foregoing action will allow lower support members to return empty but supporting meanwhile the upper support members will move unsupporting whereas gravity will pill all remaining stack of lids down supported underneath by the lower support members, thus completing one dispense and recharge cycle.

The present cup lid dispenser is activated by manually operating the yoke-lever, but it should be understood that this action could be automatically achieved by an electric motor or the like whereas the switching action could be manually, or automatically triggered.

Let it be further understood that this cup lid dispensing apparatus;

(a)—is displayed with an elongated cylindrical housing, but this apparatus will work with other shapes and configurations whereas cup lids are slidable and ovally wedgable inside.

(b)—requires no special materials or manufacturing skills to build.

(c)—displayed excellent results with off the shelf plastic coffee cup lids with or without pull off tabs.

(d)—where cup lid stability and sanitation is not a problem, upper housing portion and loading door may be eliminate.

(e)—may be bracketed to vertical wall whereas no support cabinet is necessary.

(f)—engineered to work best by placing cup lids upside down from their normal usage whereas liquid side of cup lid is protected from contaminates.

Let it be further understood that the embodiments interacting together in this invention is the object and not the shapes thereof Let it be further understood that the types and configurations of pivot points, springs, attaching means, and the like are not the object of this invention.

The present invention apparatus has the following moving parts, #1—one pair identical twin pivoting support plates, #2—one pair identical twin resilient flat spring jaws, and #3—one Yoke-lever member.

The present dispensing apparatus has at least one elongated member whereas a vertical nesting stack of lids are laterally stable therein and, The foregoing is considered as illustrative only of the principals of the invention. Further, since numerous modifications and changes to the exact construction and operation may occur by those skilled in the art, it is not desired to limit the invention to the exact construction and operation shown and described.

What is claimed is:

1. A lid dispensing method, comprising sequential steps:

supporting vertically from underneath bottommost lid, a stack of cup lids and, wedging-supporting vertically, first lid overlaying bottommost lid;

removing said underlying support therefrom said bottommost lid in the stack, allowing said bottommost cup lid to drop free, below the stack;

restoring underlying support, meanwhile unwedging-unsupporting said overlaying lid thus, allowing said overlaying lid and all remaining stack of lids lying thereon to drop down supported underneath, thus completing one lid dispensing cycle.

2. Dispensing method according to claim 1, performed upon plastic cup lids having a flange like peripheral skirt adapted to fit down onto a cup.

3. A lid dispensing apparatus and method comprising an elongated housing with a cup lid loading door and, loading a stack of cup lids into said elongated housing upside down relative to their normal usage and, a supporting means adapted to partly underlie and thereby vertically support the bottommost lid and all other lids in such stack lying thereon, and in a sequence of dispensing steps;

a wedging-supporting means adapted to wedge-support and unwedge-unsupport in the sequence, the lid first overlaying the bottommost lid and, a means for sequencing the action of the forgoing means so as to dispense the cup lids one-by-one from the bottom of the stack.

4. A lid dispensing apparatus comprising an elongated housing oriented substantially vertically with inner wall dimensions housing a stack of cup lids slidable and wedgable, with embodiments comprising;

a—a pair of resilient flat spring jaw members urging and ovally wedging first cup lid overlaying the bottommost lid, in the stack, vertically supporting said overlaying lid and all lids lying thereon and, b—a pair of laterally pivoting support plate members initially supporting said stack of cup lids vertically from underneath bottommost lid in said stack of lids and, c—a pivoting yoke member for sequencing the action of the forgoing members whereas;

dispensing cup lids one-by-one from a nesting stack of said lids by placing said nesting stack inverted from their normal usage, inside said elongated housing and, supporting initially, underneath the bottommost lid in the stack by the lateral pivoting support plate members whereas partly blocking lowermost opening in said vertical oriented elongated housing and, sequencing said apparatus by acting upon lever portion of said yoke member whereas said action will, urge laterally inward, said pair of resilient flat spring jaw members which will engage opposing outer flanges of such cup lid that first overlays the said bottommost lid and, further engaging-urging will force jaw portion of said resilient flat spring jaw members to curve along an inward-upward-arcing path whereas, said first overlaying cup lid will become;

flexed, elevated, and ovally wedged inside said elongated housing, whereas said first overlaying lid and all lids lying thereon are slightly elevated, supported vertically and, continued sequencing action upon said yoke member, will move said pivoting support plate members to an unsupporting configuration, allowing said bottommost lid to fall free dispensed and, releasing said yoke member, will sequentially allow said lateral pivoting support plate members to return supporting and, meanwhile allow resilient flat spring jaw members to release, unwedging-unsupporting, whereas said overlaying lid and all remaining lids in said stack of cup lids, will settle down supported underneath by said resting support plate members thus completing one dispense and recharge cycle for cup lids.

* * * * *